US005373675A

United States Patent [19]

Ellison, Jr.

[11] Patent Number: 5,373,675

[45] Date of Patent: * Dec. 20, 1994

[54] COMPOSITE BUILDING SYSTEM AND METHOD OF MANUFACTURING SAME AND COMPONENTS THEREFOR

[76] Inventor: Russell P. Ellison, Jr., 109 Ralston Rd., Richmond, Va. 23229

[ * ] Notice: The portion of the term of this patent subsequent to Sep. 15, 2009 has been disclaimed.

[21] Appl. No.: 886,436

[22] Filed: May 20, 1992

Related U.S. Application Data

[63] Continuation-in-part of Ser. No. 603,515, Oct. 26, 1990, Pat. No. 5,146,726.

[51] Int. Cl.[5] ..... E04B 5/10

[52] U.S. Cl. ..... 52/320; 52/743; 52/744

[58] Field of Search ..... 52/320, 743, 744, 340, 52/259, 323, 324

[56] References Cited

U.S. PATENT DOCUMENTS

| | | | |
|---|---|---|---|
| 1,052,142 | 2/1913 | Guastavino | 52/320 |
| 1,321,213 | 11/1919 | Johnson | 52/324 |
| 1,347,146 | 7/1920 | Davis | 52/324 |
| 1,843,112 | 2/1932 | Denison | 52/320 |
| 1,863,981 | 6/1932 | Groves | 52/324 |
| 2,154,390 | 4/1939 | Akers | 52/320 |
| 4,147,009 | 4/1979 | Watry | 52/744 |
| 4,191,001 | 3/1980 | L'Heureux | 52/743 |
| 4,342,181 | 8/1982 | Truesdell | 52/743 |
| 4,563,852 | 1/1986 | Achtenberg et al. | 52/743 |
| 4,573,303 | 3/1986 | Figari | 52/743 |
| 5,146,726 | 9/1992 | Ellison, Jr. | 52/320 |
| 5,163,263 | 11/1992 | DeSchutter et al. | 52/743 |

*Primary Examiner*—Carl D. Friedman
*Assistant Examiner*—Wynn E. Wood

[57] ABSTRACT

A composite building system includes a joist having a lower flange in one embodiment and a ladder reinforcement in another embodiment, a plurality of masonry blocks defining a longitudinal trough, the blocks having mutually co-planar upper surfaces and at least one stepped upper edge, the stepped upper edges of the plurality of blocks running substantially transverse the trough in a grid-like pattern, a network of wire lateral reinforcement disposed in at least some of the stepped edges; and a flowable or fluid grout filling the stepped edges and the trough and, when cured, binding the joist or ladder reinforcement and the plurality of blocks to form an integral structure having a substantially planar upper surface.

8 Claims, 13 Drawing Sheets

COMPOSITE BUILDING SYSTEM AND METHOD OF MANUFACTURING SAME AND COMPONENTS THEREFOR

CROSS REFERENCE TO RELATED APPLICATION

This application is a continuation-in-part of co-pending U.S. patent application Ser. No. 07/603,515 filed Oct. 26, 1990 now U.S. Pat. No. 5,146,726.

BACKGROUND OF THE INVENTION

1. Field of the Invention

The present invention relates generally to building structures and, more specifically, to a building system and method using masonry blocks, grout, open web steel joists and/or other metal reinforcements.

2. Description of the Related Art

Concrete is a widely used structural and civil engineering material today. Its applications range from small objects like fence posts to roads, dams, and other massive structures.

The key to concrete's wide structural use is in its inherent strength under compression. Although concrete by itself is very strong in compression, it has limited strength in tension and bending. Thus, it is common practice in forming slab structures, such as building floors, to reinforce the concrete. Most reinforcement is in the form of round-section mild steel. The bond between the concrete and the reinforcement is very important and as a result "deformed" bars are widely used to increase the bond. Another common technique for strengthening slabs of concrete is to prestress the concrete by placing tensioned steel bars, strands or cables in the slab prior to setting of the concrete so that when set, the prestressed concrete slab will be under constant compression.

Floor slabs and other structural components can be in the category of "precast" in that the concrete does not need to be cast on the construction site. There are some advantages associated with precasting concrete, including the reduction of on-site work in congested locations, and the control of standards of quality and the environment so as to avoid rain, freezing, etc.

A problem exists in certain building construction situations in that, it is difficult to obtain and use the heavy equipment which is necessary to lift and place the concrete slabs on their supports. While it is possible to avoid precast structures by casting the slab in place, another problem arises in that forms made of wood or other material must be built in place and the retrieval of the forming structures is very difficult. Moreover, the cost of forming concrete on the site is expensive, although the per unit cost can only be decreased if the form material and methods can be re-used. Nonetheless, forming, pouring and finishing a concrete slab takes special skills and equipment, thus resulting in costs that can be prohibitive unless the building structure is very large so as to afford repetitive forming.

Thus, a need exists for alternatives to precast or cast on-site concrete floor slabs and structures for walls, and roofs and other relatively flat structures.

SUMMARY OF THE INVENTION

An object of the present invention is to provide a composite building system which is capable of being fabricated by non-specialized workers using existing non-costly building materials.

Another object of the present invention is to provide a composite building system which can be used to fabricate structural units, such as floor slabs, in place, thereby obviating special transportation and lifting needs for large, pre-cast concrete products.

Another object of the present invention is to provide a composite building method which can be used on-site to construct structural units quickly and inexpensively.

Another object of the present invention is to provide a composite building system which does not require temporary shoring.

A further object of the present invention is to provide a method of fixing reinforcement to concrete and masonry surfaces by flowing a fluid grout into an opening in dry concrete or masonry structure where a metal reinforcement is located and utilizing the absorption capabilities of the concrete or masonry structure to remove sufficient water from the grout to increase its strength and reduce shrinkage. The masonary structure is usually made from a multiplicity of individual masonary blocks. Also, this method and resulting product is of special use in attaching reinforcement to masonry blocks on the opposite side of the blocks from which a fluid grout is poured.

Yet another object of the present invention is to provide a composite building system which is capable of reducing the overall cost of fabricating and installing floor slabs, roof slabs, tilt-up wall sections, etc.

Still another object of the present invention is to create a composite building system which is capable of fabricating large structural slabs either on-site or off-site with inexpensive and universally available construction materials that requires only readily made changes to those standard components.

These and other objects of the invention are met by providing, in some instances, a composite building system which includes a joist having a lower flange, a plurality of masonry blocks laid on their side supported on opposite sides of the joist by the flange and defining a longitudinal trough in which the joist is disposed, the blocks having mutually co-planar upper surfaces when laid on their side and at least one stepped upper edge running substantially transverse to the trough in a grid-like pattern, a network of wire lateral reinforcement disposed in the step edges of the plurality of masonry blocks, and a flowable grout filling the stepped edges and the trough, and when cured, binding the joist, the wires, and the plurality of blocks to form an integral structure having a substantially planar upper surface and strength substantially greater than the joists acting alone.

The aforementioned composite building system can be used to fabricate a plurality of building components, such as floor slabs. The blocks are preferably a standard size masonry concrete block (either nominally 16 inch or 24 inch long) with only minor modifications and the joist is a special open-web-type joist capable of spanning from support to support. These joists are similar to standard steel bar joists and preferably can be made by the same manufacturing techniques. These special joists are preferably of minimum weight and are easy to handle such that for most spans, one individual could lift and position the joist during the assembly of the building system. Typically, the span is 16 feet or less for a 7-inch deep joist and nominally 8-inch block. This span length covers 95% of all residential construction. This type of joist is also called a "bar joist" because it typically is a welded truss assembled from steel bars and steel angles. In the present composite building system the special joist has two angles back to back at the bottom so as to provide a flange portion on opposite sides of the joist for supporting the blocks on opposite sides of the joist.

Another form of the aforementioned composite building system may be used to fabricate a plurality of masonry blocks into relatively flat sections for use as floors, roofs, walls and alike by the use of a ladder type of steel reinforcement of a size to accommodate the concrete blocks. The masonry concrete blocks are placed on their side in a horizontal plane adjacent one another with the reinforcement located at joints between the blocks. A fluid grout is poured from the top position into the joints and is sufficiently liquid to penetrate the joints and reinforcing steel even when it is located on the bottom side of the blocks. Normally a fluid grout with sufficient water to make it liquid enough for such penetration would be weak. However, the block is chosen to be sufficiently dry with sufficient absorbent capabilities to remove enough of the water to permit the resultant grout, once hardened, to have sufficient strength and reduced shrinkage for the bonding of the steel reinforcement to the blocks.

These and other features and advantages of the composite building system and method of the present invention will become more apparent with reference to the following detailed description and drawings.

BRIEF DESCRIPTION OF THE DRAWINGS

FIG. 7(*a*) is a partial cross-section showing a one-piece bottom chord.

DETAILED DESCRIPTION OF THE PREFERRED EMBODIMENTS

Figure 1:
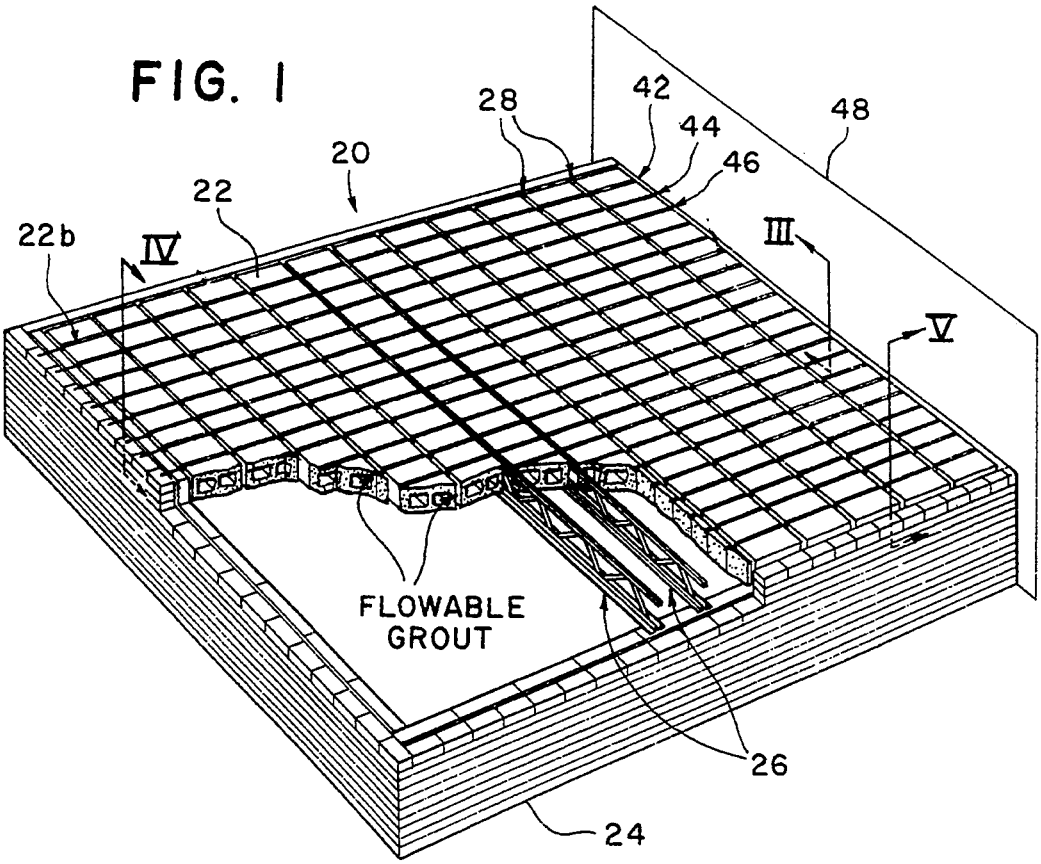
FIG. 1 is a perspective view, partially cut away, showing a composite building system according to the present invention used to create a floor slab which is illustrated on a foundation.
Figure 2:
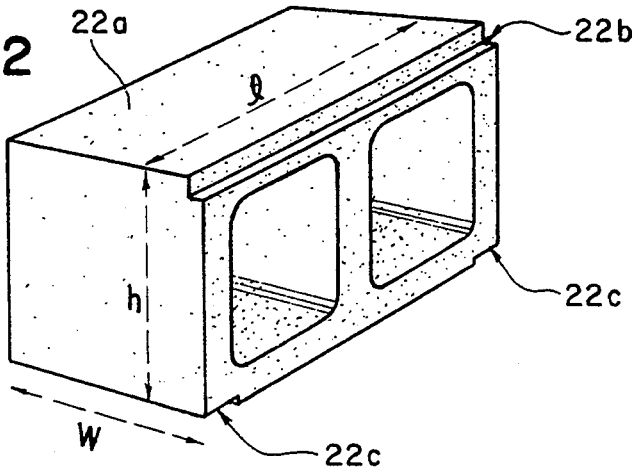
FIG. 2 is a perspective view of a masonry block laid on its side used in the composite building system and floor slab illustrated in FIG. 1.

Referring now to FIG. 1, a composite building system according to the present invention is generally referred to by the numeral 20. The system 20 is a composite of inexpensive and easily accessible and workable materials including a plurality of masonry blocks 22 laid on their sides arranged side-by-side and end-to-end to form a floor slab which, in the embodiment illustrated in FIG. 1, is assembled on a foundation which provides support for the ends of joists 26 which are part of the composite building system 20 and will be described in greater detail below. The blocks are ordinary concrete blocks which, when using a 7 inch joist, are normally $8\times8\times16$ inches. The block is commonly referred to as a "pier" block because it has a flat surface on both ends. It can be made of cement and hard rock aggregates or it can be made of cement and light weight aggregates. The 16 inch dimension is illustrated in FIG. 2 as the "l" (length) dimension, while the two 8 inch dimensions are referred to by the "h" and "W" for the "height" and "width" dimensions, respectively. However, it is to be noted that normally a block is considered standing up when its cores are vertical and that is the way it should be considered in this specification. Therefore, since the block is on its side in FIG. 2, the "h" is actually the width or thickness and the "W" is actually the height. Normally, this type of block is hollow and is laid down so that side 22*a* and its opposite counterpart are vertically disposed. In the present invention, the blocks are supported by the joists 26 with the surfaces 22*a* arranged horizontally so as to be co-planar, thereby collectively forming the upper surface of the floor slab. An $8\times8\times16$ hollow block typically weighs between 22 and 32 lbs. and can thus readily be handled by a single workman.

One aspect of the present invention is to provide a modified concrete block whereby at least one of the upper edges of the block is stepped as shown in FIG. 2 to form a groove referred to by the numeral 22b. Referring again to FIG. 1, when the blocks 22 are arranged end-to-end, a plurality of parallel troughs 28 are formed parallel to each other and each trough contains one of the joists 26. The stepped edge 22b of each block 22 formed in the side surface 22a are aligned so as to be transverse the troughs 28 thereby creating a grid-like pattern. A continuous groove is formed by aligning the stepped edges of all of the blocks in a given row.

The stepped edges 22b of all of the blocks 22 provide a plurality of transverse grooves which are preferably about ½ inch wide and about ¾ inch deep. The 8 inch block (8×8×16 or 8×8×24) is used in conjunction with a 7 inch (height) joist, which is a standard, relatively inexpensive building material. A 12 inch block (12×8×16) could be used if a deeper joist were required.

Figure 6:
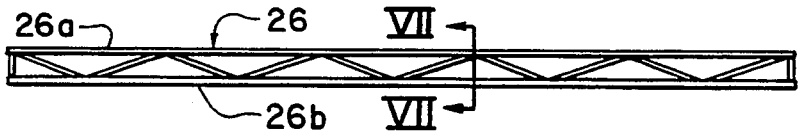
FIG. 6 is a side elevational view of a joist used in the composite building system of FIG. 1.
Figure 7:
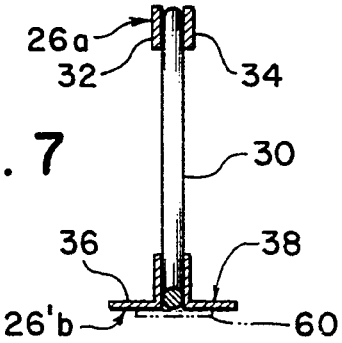
FIG. 7 is a sectional view of the joist of FIG. 6, taken along line VII.
Figure 7A:
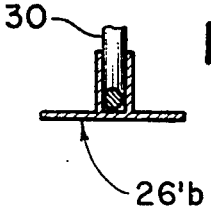

Referring to FIGS. 6 and 7, each joist 26 has an upper chord 26a and a lower chord 26b. This joist is commonly referred to as a "bar joist" and has a web member 30 with a number of spaced top points and bottom points which is welded to the upper chord 26a and the lower chord 26b respectively. The upper chord 26a includes a pair of ¼ inch by 1 inch bars 32 and 34 which run the length of the joist. The lower chord 26b includes a pair of angle bars 36 and 38 which also run the length of the joist and are connected by welding to the web member 30 back-to-back so as to provide a flange which extends orthogonally outwardly from opposite sides of the web member 30. Each angle bar 36 and 38 is of standard dimensions, 1 and ½ inches by 1 and ½ inches by ⅛ inch. The steel used in fabricating the joist 26 has a yield strength of 50,000 psi in the web member and angles and 36,000 psi in the bars forming the upper chord. The flange provided at the bottom is essential for supporting the blocks at their ends, so that one joist 26 will support the ends of two blocks from opposite sides. Of course, the number of blocks supported on each side of the joist is dependent on the length of the joist. A flat bar or special shape like 26b in FIG. 7(*a*), may be used instead of the angle bars, 36 and 38.

Figure 3:
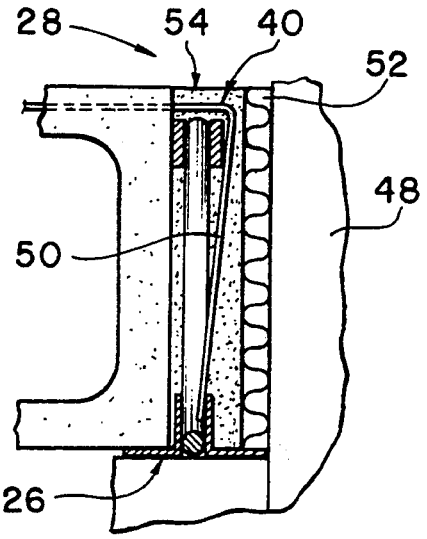
FIG. 3 is a sectional view taken along the line III of FIG. 1.
Figure 5:
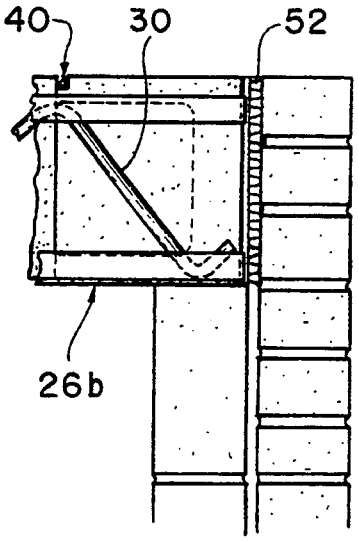
FIG. 5 is a sectional view taken along line V of FIG. 1.
Figure 4:
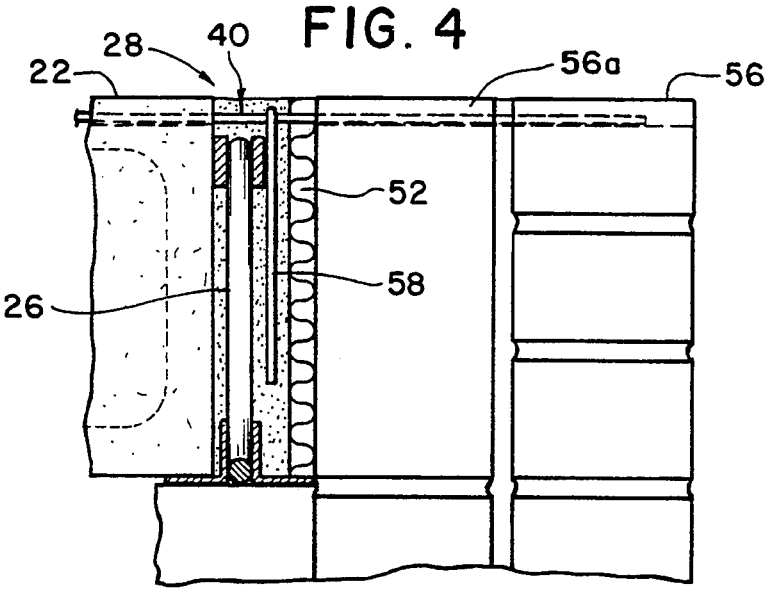
FIG. 4 is a sectional view taken along the line IV of FIG. 1.

Transverse grooves are provided so that, when the grooves are filled with grout, the blocks are in continuous and intimate contact with each other. The transverse grooves are also provided for embedding a network of wire reinforcement. As shown in FIGS. 3–5, the network of wire reinforcement includes a plurality of wires 40 which are placed in the grooves prior to the application of a grout. The wire is preferably 9 gauge deformed wire cut in lengths to be disposed preferably in every groove. However, in an alternative embodiment, 8 gauge wire could be disposed in every other groove. In this instance, the word "groove" refers, in FIG. 1, to the groove which runs the entire width of the foundation, from end-to-end, and which is made of a plurality of individual stepped edges 22b. The collective groove is referred to in FIG. 1 as groove 42 and it runs from one side of the foundation to the other. If 9 gauge wire is used, each of the collective grooves, such as grooves 42 and 44 would contain at least one segment of 9 gauge wire (if the wire was not of sufficient length to run the entire length of the foundation, two segments of wire would be to be laid in with overlapping end portions). If 8 gauge wire is used, then, for example, groove 42 would be wired, but groove 44 would not be wired. The next groove, groove 46, would contain a wire, etc.

As shown in FIGS. 1 and 3, if an existing wall 48 is in abutment with the new floor slab made according to the composite building system 20, the ends 50 of the wires 40 are bent downwardly into the joist 26. A sheet of insulation 52 can be used between the existing wall 48 and the grout 54 which is subsequently poured into the trough 28 in which the joist 26 is disposed.

As shown in FIG. 4, at the opposite side of the foundation, the upper brick 56 and block 56a of the foundation is cut to form a groove in which the wire 40 can be extended. At the trough 28 adjacent the new side wall of the foundation, a hairpin wire 58 of 9 gauge wire may be extended into the trough 28 so that when grout is filled into the trough, the hairpin wires 58 help anchor the network of wire reinforcement. This would not necessarily be used in every trough.

The grout 54 is first filled in the troughs 28 prior to filling the grooves with grout. In order to keep the grout from running out at the bottom of the joist when the grout is in a plastic state, duct tape or other suitable means can be attached to the bottom of the lower chord 26b (see FIG. 7). The duct tape illustrated in FIG. 7 in phantom lines is referred to by the numeral 60 and can be placed over the bottom of the lower chord 26b prior to assembly of the components of the building system. The tape is intended to prevent grout from leaking out from the bottom chord 26b. Such tape 60 would not be necessary if the bottom chord 26'b was formed as a single piece as shown in FIG. 7(*a*). This would require the construction of a specialized joist and, while this could be done, joists according to FIG. 7 are currently commercially available.

Figure 8:
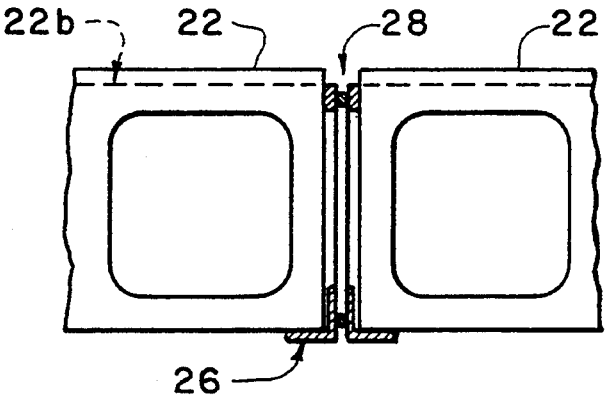
FIG. 8 is an enlarged sectional view showing two blocks supported by a joist according to the composite building system of FIG. 1.

FIG. 8 provides a better illustration of a typical trough 28 in which a joist 26 is disposed while supporting two adjacent blocks 22 at their opposing ends. Also shown in FIG. 8 are the transverse grooves formed by the stepped edges 22b. Once the blocks 22 are assembled in place, grout is filled in the troughs 28, but preferably, not in the grooves until after the grout in the troughs 28 has had a chance to settle for about 30 minutes.

After the troughs 28 have been filled, then grout is filled in the grooves formed by the stepped edges 22b so that the upper surface of the floor slab is substantially planar and smooth. The grout is a mixture of fine sand and Portland cement which may include admixes to provide a liquid consistency without an excessive amount of water for pouring into the troughs 28 and the grooves. Admixes such as super-plasticizers, air entraining agents, retarders, water reducers, etc., are well known and commercially available from a number of sources and would be used when and if desired. Preferably, the grout is made flowable so that it is unnecessary to use vibration or other means to fill all the voids in the area of the trough. The blocks should usually be dry when the troughs 28 are filled with flowable grout containing no admixes. The blocks quickly absorb the excess mixing water. The top surface of the block should be moistened prior to the filling of the grooves 42, 44 and 46 so that the grout in the grooves will not dry out too quickly.

Also, to be noted from FIG. 8, the blocks are taller than the joist, the upper chord is narrower in width than the lower chord, the web is narrower in width or thickness than the upper chord, the bottom edge of the block rests on the flange, the blocks have straight vertical sides that abut the upper chord.

Figure 9:
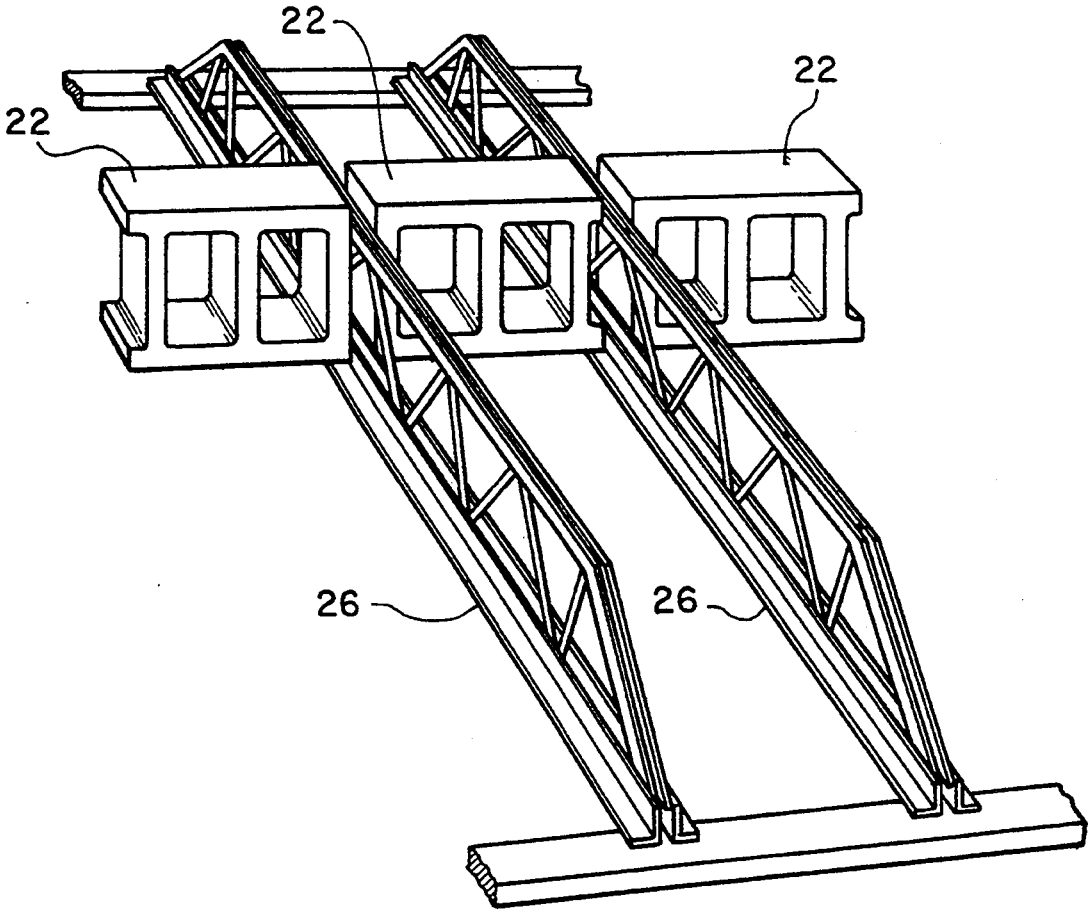
FIG. 9 is a perspective view of a partially assembled composite building system according to FIG. 1.
Figure 10:
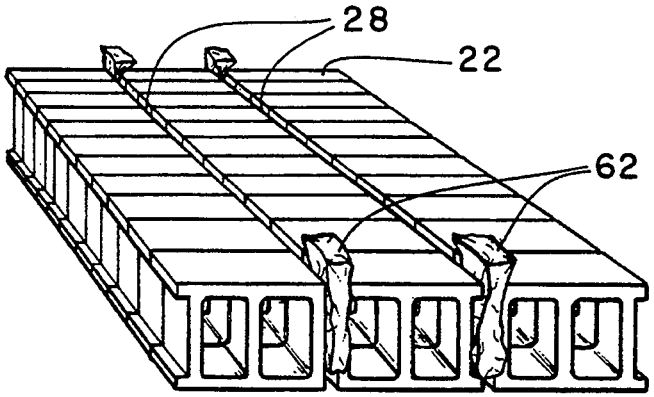
FIG. 10 is a perspective view of the composite building system in an intermediate condition of assembly.
Figure 11:
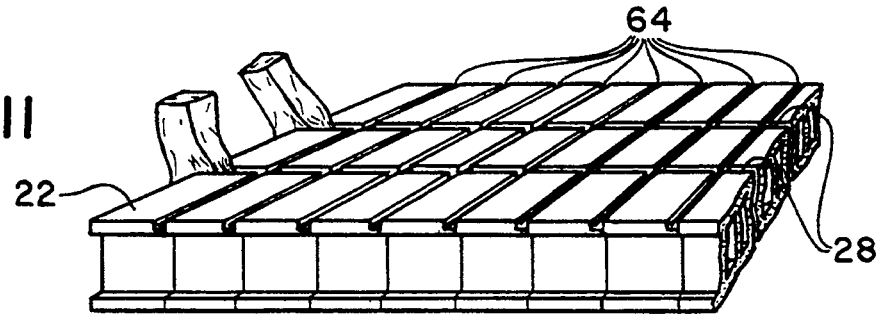
FIG. 11 is a perspective view of a composite building system of FIG. 1, partially cutaway, in a subsequent, intermediate condition of assembly.

Referring to FIGS. 9–12, a composite building system is shown in various stages of assembly. The joists are omitted from FIGS. 10–12. In FIG. 9, two joists 26 are placed side-by-side and parallel to each other, and a plurality of blocks 22 are placed on the flanges of the joists 26. The beginnings of two troughs 28 can be seen as to be formed between the juxtaposed ends of the blocks. Fully developed troughs are seen in FIG. 10 after all of the required blocks have been placed in their respective positions.

In order to fill the troughs with grout, grout obstructions 62 are placed in the opposite longitudinal ends of the troughs so that grout cannot flow out the ends. The obstructions 62 can be of any suitable means. The illustrated examples shows foam rubber or sponge-like material which can be easily deformed and fitted into irregular spaces.

After the obstructions 62 have been placed in the opposite ends, grout is poured into the troughs and is filled to approximately ¾ inch from the top. At this point, if the blocks 22 are of the type illustrated in FIG. 2, having a preformed stepped edge **22*b*, the method of assembly can proceed to the next step. However, if standard blocks are used as illustrated in FIGS. 9 and 10 (with no stepped edges) the transverse grooves must be formed by cutting with a masonry cutting saw so as to form the grooves shown in FIG. 11. These cut grooves, referred to by the numeral 64** can be formed on-site relatively easily with a standard cutting tool which consists of a circular saw blade.

Figure 12:
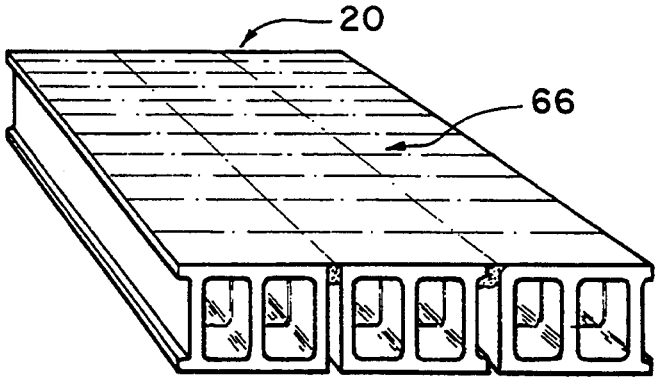
FIG. 12 is a perspective view of a finished composite building component using the composite building system of FIG. 1.

FIG. 12 is a view of the composite building system 20 made according to the present invention and consisting of a floor slab which can be lifted into place by a relatively small lift machine, or alternatively, the same structure could have been fabricated in-place, thus requiring no mechanical lifting means. If assembled outside its intended place of use, the floor slab shown in FIG. 12 can easily be lifted by a fork lift or crane and moved to the desired position. The slab shown in FIG. 12 has an upper surface 66 which provides a floor for a building structure. The opposite side (not visible in FIG. 12) would provide the ceiling when the structure is used as a floor or roof slab.

The resulting structure illustrated in FIG. 12 is one which has physical similarities to a reinforced concrete slab of comparable thickness. Hollow blocks are used, and preferred, because they are cheaper and lighter, but solid blocks may be desirable under certain loading conditions or for sound attenuation.

As mentioned previously, the present invention is not limited to one size block and joist. For example, a larger span, in the range of 24 feet, could be accomplished with an 11 inch deep floor joist and a 12×8×16 block. 12×8×16 blocks spanning twelve inches instead of 16 inches would permit spans in the 32 foot range with 15 inch floor joist. Conversely, for shorter spans and lighter loads, the floor joists can be smaller and lighter. In any case, the top of the joist should be slightly below the height of the block so that it is always buried in the trough by grout and the transverse wires can be suitably embedded in grout.

It should also be noted that the system provides a smooth top surface suitable as a sub-floor, but the same system could be used to make a roof deck or other building structures. If a smoother surface is desired, or a load distributing under-layment is desired, a skim coat, concrete topping, gypsum topping, or a plywood-type under-layment may be added. The resultant structures are extremely fire-resistant since the concrete will act as a heat sink and thereby keep the temperature of the joist from rising too rapidly in a fire.

The block illustrated in FIG. 2 can also be provided at the bottom edges with grooves **22*c* at the opposite ends so that the flanges of the joists are flush with the bottom of the block when the block is on its side as in FIG. 2**. This provides a smoother ceiling.

From beginning to end, the method of constructing the system goes as follows:

First, the open web steel joists are produced or cut to a desired length and 2 inch wide duct tape is applied to the bottom of each joist so as to prevent grout loss. Next, weld burrs are chipped off or ground off with a grinding tool since these may act as obstructions which prevent the blocks from pressing uniformly against the ¼ inch by 1 inch top chord bars. Where the top chord bars are closer than one-half inch apart, they must be pried apart to maintain the designed one-half inch gap or opening between them. This gap or opening is necessary for applying the grout into the troughs.

While steel normally used for standard bar joists is the normal material for making the special joists of this invention, they may be made of other materials. An example would be stainless steel for use over swimming pools.

Next, the joists are placed on their respective supporting structures, such as the foundation illustrated in FIG. 1, with the bottom chord of the joist being hard against the non-load bearing walls. Then, cap blocks are placed one at each end of the joists, solid side out. This will space and brace the joists. If desirable, perimeter insulation board can then be placed against the inside face of the bricks or other masonry at the ends of the joists and against the non-load bearing walls.

Next, the remaining blocks are placed in their respective positions, beginning at one end of the joists (at one bearing wall) and proceeding to the other end, laying a row at a time. In other words, all of the blocks between two joists should not be laid before laying the blocks between the other joists. Thus, it is important that one course be laid at a time from one bearing wall to the other, bumping the blocks tight against each other and maintaining the transverse grout groove in a straight line between all blocks. The grout grooves are then cut in the top of the block and brick non-bearing wall in line with the grooves in the blocks. Next, 10 foot segments of 9 gauge wire are laid in the grout grooves, overlapping them in the middle after bending the ends at the existing wall. The 9 gauge hairpin wires are then dropped over the transverse wires adjacent the non-load bearing wall. A flowable grout based on 2½:1 sand-/Portland-cement mixture is poured into the space between the blocks and the floor joists without vibration. The flowable grout is poured into the longitudinal joints or troughs so that the joists are completely encased in grout. After a suitable delay of about 30 minutes, and after wetting the top surface of the block, the transverse grout grooves are then filled, making certain that the 9 gauge wires are fully embedded in the grout. After this, the upper surface is screeded, floated or trowelled to be as smooth as desired and the structure is covered with a polyethylene sheet for curing.

The finished product has been found to be remarkably strong and at least comparable to reinforced concrete slabs of comparable thickness.

Figure 13:
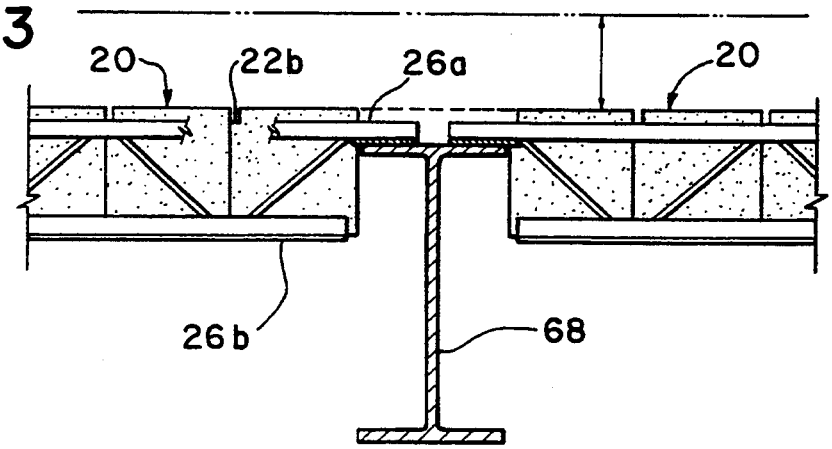
FIG. 13 is a view similar to FIG. 5 showing a top chord bearing.

In the system illustrated in FIG. 1, the fabricated floor slab is bottom-chord-bearing, in that the bottom chord **26*b*** bears on the upper surface of a supporting structure. FIG. 13, however, illustrates an arrangement whereby the system is top-chord-bearing, whereby the top chords 26a are bearing on a steel I-beam 68. When bearing is under the top chord instead of the bottom chord, a shallower framing system can result. The difference in overall height is illustrated in FIG. 13 by a broken line drawn parallel to the upper surface of the slabs (indicated by the reference numerals 20, which refer to the composite building system). The top chord bearing joists should be fabricated to length (as opposed to being cut on-site), but this should be acceptable to the fabricator because of the large quantity that would be required for a multi-story structure. The saving in height from top chord bearing becomes relatively greater as the depth of the floor/roof system increases.

Figure 14:
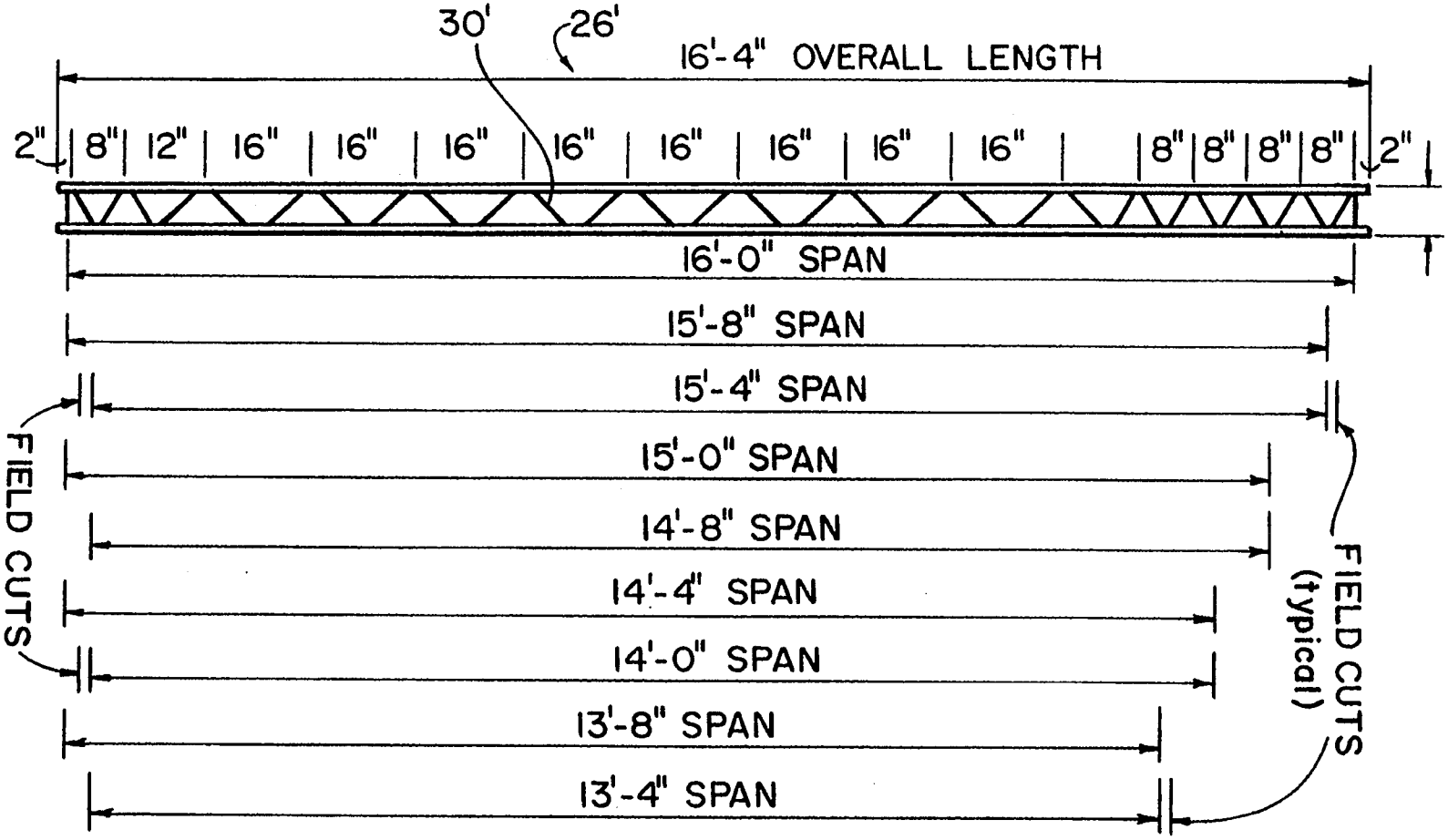
FIG. 14 is a view showing a joist with different span lengths.

FIG. 14 illustrates a joist 26′ of the present invention which may be fabricated to provide greater latitude in making field cuts of the joist to suit specific length requirements. Normally, the web member 30′ undulates at 16 inch intervals and the spans must be cut to lengths where the undulations touch the upper and/or lower chords. Normally, the undulations occur regularly at the aforementioned 16 inch intervals. According to the present invention, however, the joist has an undulating web member 30′ which, at the opposite end portions, undulates at 8 inch intervals, and at a 12 inch interval, so that a variety of spans can be cut in the field. This is made possible by the fact that the web member 30′ contacts the upper and lower chords at closer intervals, and at intervals of different lengths so that, a combination of cuts at opposite ends can result in a desired span length.

With reference to FIGS. 15 through 25 there is shown another embodiment of the invention which utilizes fluid grout and normally it would not utilize the bar joist. The system of FIGS. 15 through 25 is a reinforced slab made of special concrete masonry units and a specially sized ladder-type reinforcing steel plus standard reinforcing steel bars and a fluid grout. It is fabricated into slabs and cured prior to handling and is normally set into place with a crane. The keyway between slabs is grouted after setting the slabs into place and placing suitable reinforcing bars in the keyway. Once prefabricated, slabs are handled similarly to the well known prestressed concrete hollow core slabs. The type of structure and method shown in FIGS. 15 through 25 is utilizable when the economics of the job permit the use of a lightweight crane or similar work handling machine.

Briefly, the slab of FIGS. 15 through 25 is preferably premanufactured on a flat surface, optionally cambered to offset the anticipated dead load deflection of the finished slab, with the blocks in stack bond with a ladder-type wall reinforcement placed between each course within grout grooves. The slabs can be made in various widths and thicknesses depending on the size of the blocks used. Reinforcing bars cut to the length of the slab, are threaded through the joints between blocks, the open ends of the joints and grout grooves are dammed, and a fluid grout is poured into the joints and grooves filling them including the grooves or steps provided for the ladder reinforcement on the under side of the blocks.

The advantages of this system and structure is that it is expected to be less costly than any other masonry system and is competitive in cost to a wood structure especially when fire proofing is involved. This structure can readily achieve two and three hour fire resistance ratings. The structure has sound attenuation characteristics similar to a concrete masonry wall. Other advantages include overnight curing of the keyway grout rendering the system quickly ready for normal construction loads, handling stresses provide structural proof-testing of the component slabs, and because none of the steel is exposed, protection of the steel from fire and corrosion is unnecessary. Numerous other advantages are provided by the structure and include: easy design characteristics since reinforced concrete design is readily understood by structural engineers, holes and attachments are easily provided with simple tools, the structure provides both a flush ceiling and flat top surface and is readily adapted to the project since it uses construction details similar to well known common precast/prestressed slabs. The structure is shallower than wood with the same span and loading which may reduce overall building height and cost. It is more shock proof than normal structures since its double-reinforcement in both directions can sustain significant moment reversals such as those induced by handling, hauling and seismic forces. The system is very versatile since width, length, depth, and weights are as changeable as the blocks themselves.

A key to the invention shown especially in FIGS. 15 through 25 is the use of a fluid, 2.5:1 Portland cement grout made with masonry sand and with an efflux time per American Society for Testing Materials (ASTM) C939 of ten seconds. It has been found that with a 4 inch head at one end the fluid grout will completely fill a ½ inch wide by ¾ inch deep groove, 16 inch long formed between concrete blocks with a continuous 9 gauge deformed wire in the groove and will do so by gravity alone without vibration or pressure. It is important that the special concrete blocks be sufficiently dry and absorbent that they will readily absorb water from the grout and that there be sufficient mass of the block relative to the amount of grout to absorb such water. Thus the relatively large quantity of water used to make fluid grout which would normally simultaneously weaken the cured grout and cause shrinkage problems is quickly absorbed from the grout leaving the grout to have its normal strength.

Normal concrete blocks are sufficiently dry for this purpose and these are better defined under ASTM C90, Grade N, Type I. C90 means it is a hollow load bearing concrete block. Grade N means it is suitable for use anywhere that concrete masonry can be used and Type I means that it is moisture controlled or that it is dry. Of course other types of masonry having similar characteristics would be applicable to the invention and the grooves provided for the reinforcement would define a volume small enough relative to the total masonry unit to permit sufficient water absorption from the fluid grout that would be used to fill the grooves.

It has been found that the grouted groove, when cured, is stronger in compression than the concrete of the surrounding blocks and that the bond of the reinforcing steel to the grout, and the grout to the blocks, is 100%. Since the bond of the grout to the reinforcing steel is as complete as it is in ordinary reinforced concrete the design engineer can assume a full development of the properties of the reinforcing steel.

After the slabs have been erected, the joints between slabs can be reinforced and grouted to add substantially to their strength and to allow them to work together as a unit. The slabs themselves can be constructed by hand without special skills since the blocks are dimensionally true and are supported on a relatively flat surface.

Figure 17:
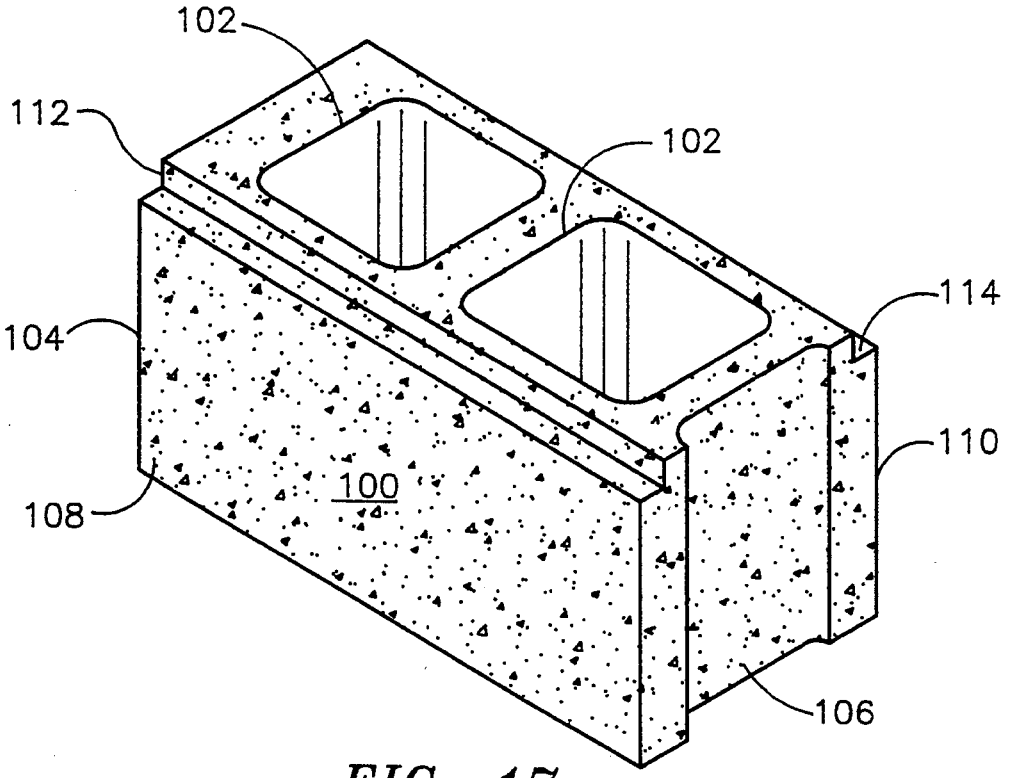
FIG. 17 is a typical masonry block used in making the slab of FIG. 16 with one end flat and the other end open.

With reference to FIG. 17 there is shown a special block 100 utilized with this invention. The block is hollow having two cores 102 and preferably made of lightweight aggregate used with normal concrete blocks which typically use concrete having a 2,000 lb. pounds per square inch (psi) strength in compression and, when formed into the block, has a compressive strength of 1,000 lb. psi over the gross area. The block has a flush or flat end 104 and an open end 106. Both the hollow cores 102 and open end 106 are tapered for both ease of manufacture, and as will appear later, the tapered open end provides advantages for the spacing and embedment of the reinforcement.

The special block has a long side 108 which is 15⅜ inches long and a short side 110 which is 14⅞ inches long. The height of the block is 7 15/16 inches to 8 inches tall and running along both the long side 108 and short side 110 at the top are respectively a long ledge 112 and a short ledge 114. Each ledge or step is ½ inch tall and ¾ inch wide and runs the entire length of the block. The ledges are designed to receive a ladder reinforcement as will be described later. The special blocks are similar to typical concrete blocks except for the varying length of the sides and the two ledges. The long side 108 is ¼ inch shorter than the typical length of an ordinary concrete block and the short side 110 is ¾ inch shorter than the length of an ordinary block. Therefore, with only minor adjustments, the present special block 100 can be readily fabricated using existing manufacturing equipment and operations.

Figure 18:
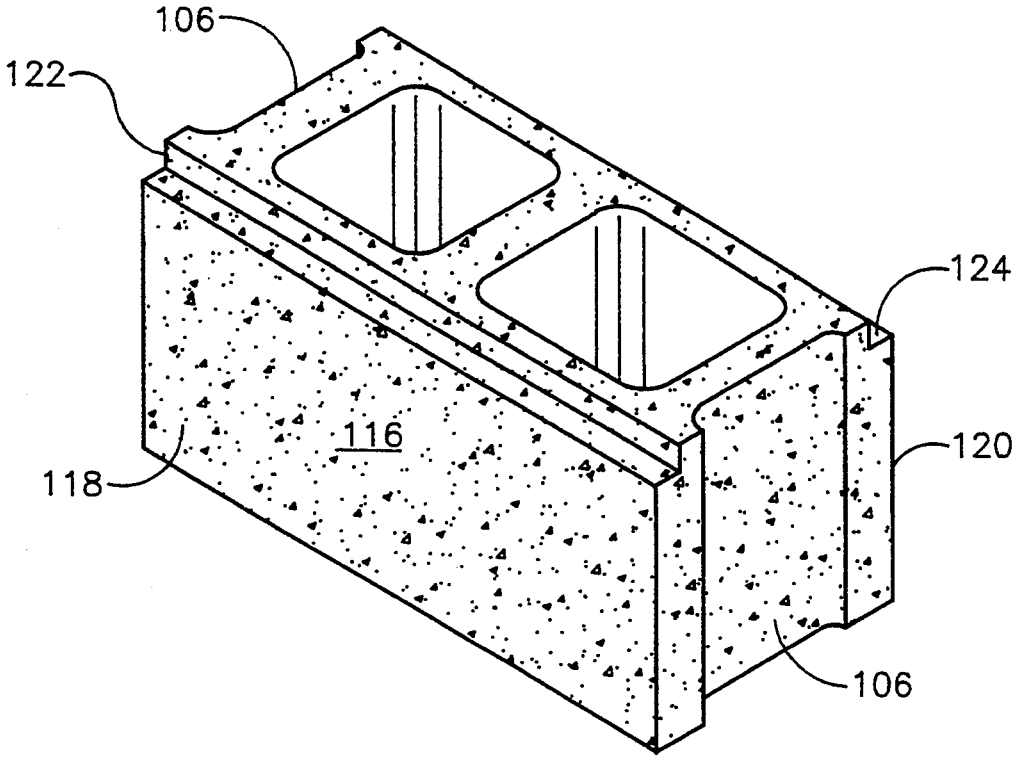
FIG. 18 shows a typical keyway masonry block having both ends open.

With reference to FIG. 18 there is shown a special block 116 identical to the block of FIG. 17 except the flush or flat end 104 has been changed to an open end so one end of the block can be used for a keyway. This keyway block 116 has a long side 118 which is 15⅛ inches long and a short side 120 which 14⅛ inches long. While the special block 100 could have had two open ends it is preferable to have one flat end to save on the quantity of grout needed for the premanufactured joints. The keyway block has a long ledge 122 and a short ledge 124.

Figures 24, 25:
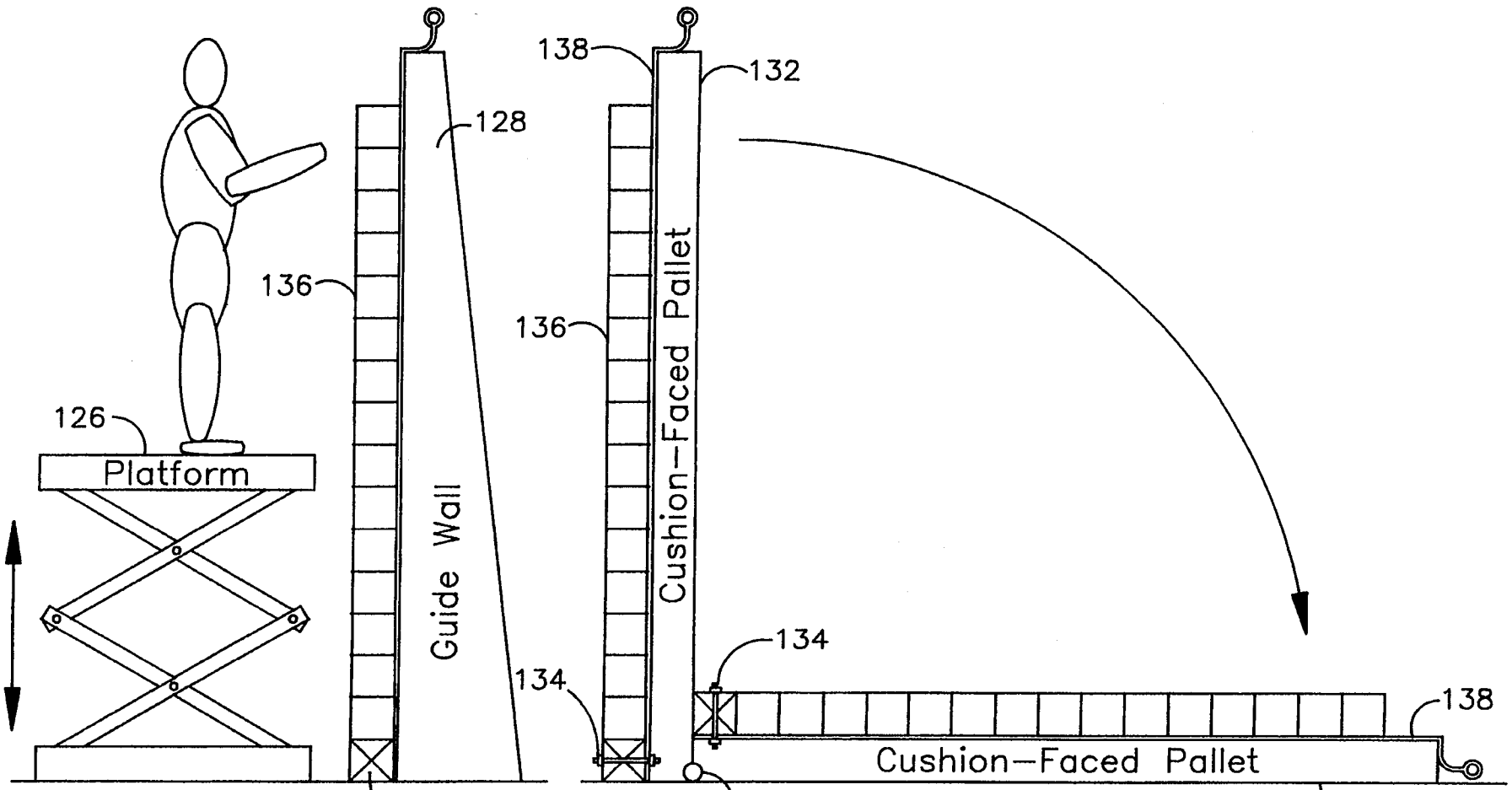
FIG. 24 is a schematic view of work person assembling blocks to prefabricate a wall utilizing the present invention.
FIG. 25 is a schematic view showing the assembled blocks being moved from the vertical position to a horizontal position prior to pouring the fluid grout.

The special blocks of FIGS. 17 and 18 may be assembled into a premanufactured wall such as shown in FIG. 24 and FIG. 25. There a workperson stands on a platform 126 to stack the special blocks 100 against a guide wall 128 until a predetermined height and width are reached. The last column or end stack of blocks may be the special keyway block 116 if the wall is to be assembled with other sections or slabs. The special blocks are stacked on a pallet support 130 which runs the entire length of the wall. Typically the height of a wall will be 8′ which would require the stacking of 12 blocks. A wall is typically 12′ long and would utilize 9 gauge special ladder reinforcing. If the wall was 16′ wide preferably an 8 gauge special ladder reinforcing would be utilized. If a 12 inch block was utilized rather than an 8 inch block the width of the wall could be as much as 25′ in length but with an 8 inch wall 16′ is an approximately practical limit in width. The limit of the width is determined to some extent by the limits of the handling equipment utilized as fewer lifts would be more economical.

With each course stacked the workperson lays horizontally a special ladder steel reinforcement as will be explained further in describing the joints and when the wall is completely stacked the workperson threads down the vertical reinforcing members which may be wire or typically number 3 reinforcing bar 152 with the size depending on the desired strength. As the wall is stacked, the platform 126 moves vertically to accommodate the increasing height. After the wall has been completely stacked, with the horizontal special ladder reinforcement 144 and vertical reinforcement 152 in place, the guide wall 128 is removed and the special cushion-faced pallet 132 is moved into a vertical position as shown in FIG. 25 in place of the guide wall. The pallet support 130 is fastened by bolts 134 to the bottom of the pallet 132 and then the pallet 132, pallet support 130 and wall 136 are lowered from the vertical position to the horizontal position about pivot 136. The cushion-faced pallet 132 has preferably a flat surface to which is affixed a cushion 138 to act as a gasket to prevent the flow of grout between the bottom flat faces of the block and the pallet. This cushion is not necessary if the appearance of extra grout on the face of the block is of no consequence but normally it would be utilized. The cushion or gasket is preferably ¼ inch thick urethane foam carpet underlayment having a water vapor impervious surface or a plastic film impervious to water vapor between the block and the foam. The ends of the joints between the block are suitably dammed so that grout cannot run from them. The dam may be in the form of turning up the cushion material and blocking it with a board or other readily available, suitable damming techniques. While the pallet is preferably flat it may be cambered to accommodate a predetermined flexing of the prefabricated walls depending on the circumstances.

Figure 19:
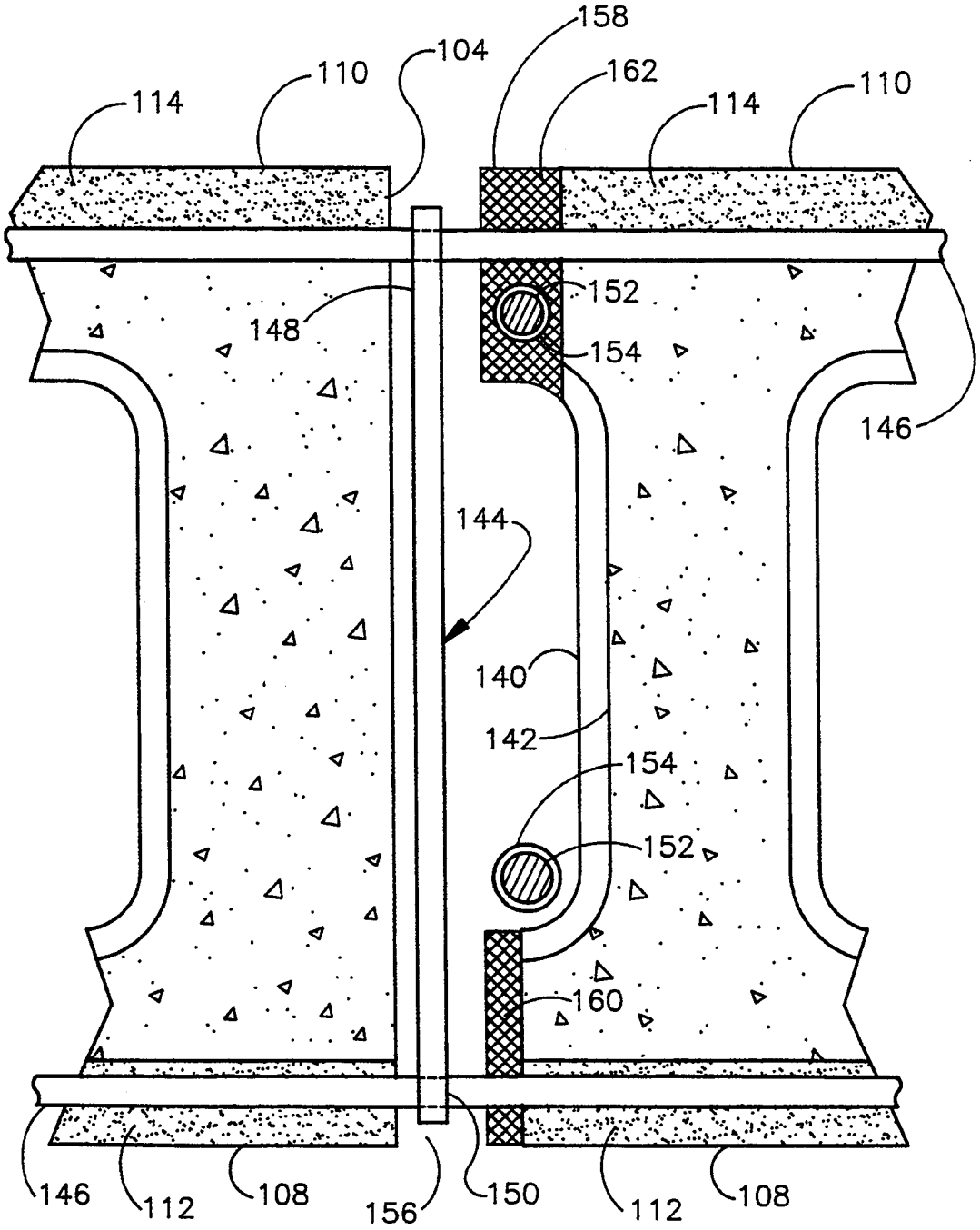
FIG. 19 is a breakaway cross-section view showing the details of a prefabricated joint made between masonry blocks.

With reference to FIG. 19 there is shown a joint between adjacent blocks after they have been stacked in FIG. 24 and lowered into the horizontal position as shown in FIG. 25. The flush end 104 is spaced from the open end 106 of the adjacent block a distance at the top of 1⅛ inches to form a grout pour opening 158 and the spacing between the blocks at the bottom is ⅝ inch to define a grout exit opening 156. The joint between the blocks is in effect a trough 157 into which fluid grout is poured.

A ladder reinforcement 144 is seen in FIG. 19. It is formed from two parallel longitudinal wires 146 which are spaced apart less than the thickness of the block which is approximately 7⅝ inches and greater than the space between the ledges 112 and 114 which is approximately 6⅛ inches so that in position the two parallel longitudinal wires 146 lay on the two ledges 112 and 114. The transverse wires 148 are perpendicular to the longitudinal wires and are parallel to one another and spaced apart a distance equal to the spacing between the blocks and are preferably on 16 inch centers. The transverse wires are welded to the longitudinal wires at joints 150. The wires are preferably formed from high strength steel approximately 70,000 psi yield strength and are preferably galvanized. The wires are slightly deformed to give a greater adherence to the grout. The ladder reinforcing steel 144 is specially dimensioned as to spacing of the wires for use with this invention. However, it is very similar to a regular ladder reinforcing steel product available for wall reinforcing and therefore can be readily made on existing machinery using existing techniques with only minor modifications. The thickness of the wire can be varied in strength or thickness as the strength requirements demand such as a 9 gauge wire for a 12′ wall and an 8 gauge wire for a 16′ wall.

As seen in FIG. 19, the reinforcing bars 152 are threaded through the joint at a perpendicular angle to the special ladder reinforcing steel 144. The reinforcing bar 152 are common and readily available reinforcing bars with deformations for improved adhesion to the grout along the surface. These deformations expand the maximum diameter of the bars as illustrated by the circle 154 in FIG. 19. Also as seen in FIG. 19, the result of the taper of the open end is shown with the taper bottom being 140 and the taper top 142. Thus, the taper bottom 140 which projects further into the joint is the only part of the block that touches the reinforcing bar 152 and then it touches only at the maximum of the deformation represented by circle 154. Therefore, the bulk of the reinforcing bars 152 are spaced from the block permitting the grout to be between the block and the reinforcing bar a sufficient distance to provide better adhesion and better fire resistance characteristics. The bars 152 shown in FIG. 19 for purposes of that example are a number 5 reinforcing bar at the bottom and a number 3 reinforcing bar at the top. Each unit of these numbers conventionally represent $\frac{1}{8}$ inch so a number 3 bar is $\frac{3}{8}$ inch in diameter and a number 5 bar is $\frac{5}{8}$ inch in diameter.

The hatched parts of the block in FIG. 19 represent the portion of a normal block that are omitted for purposes of this invention. The part omitted is $\frac{1}{4}$ inch thick at the bottom and $\frac{3}{4}$ inch at the top. The bottom portion is removed to give a greater opening 156 to permit the grout to exit into the bottom grooves 112, and the top portion is removed to give a greater pour opening 158 to permit the more readily pouring of the fluid grout. The top reinforcing bar of FIG. 19 is usually held in the elevated position by tying to the ladder reinforcement 144. The bottom reinforcing bar is held in place by gravity between the transverse member or wire 148 and the tapered bottom of the concrete block.

Figure 16:
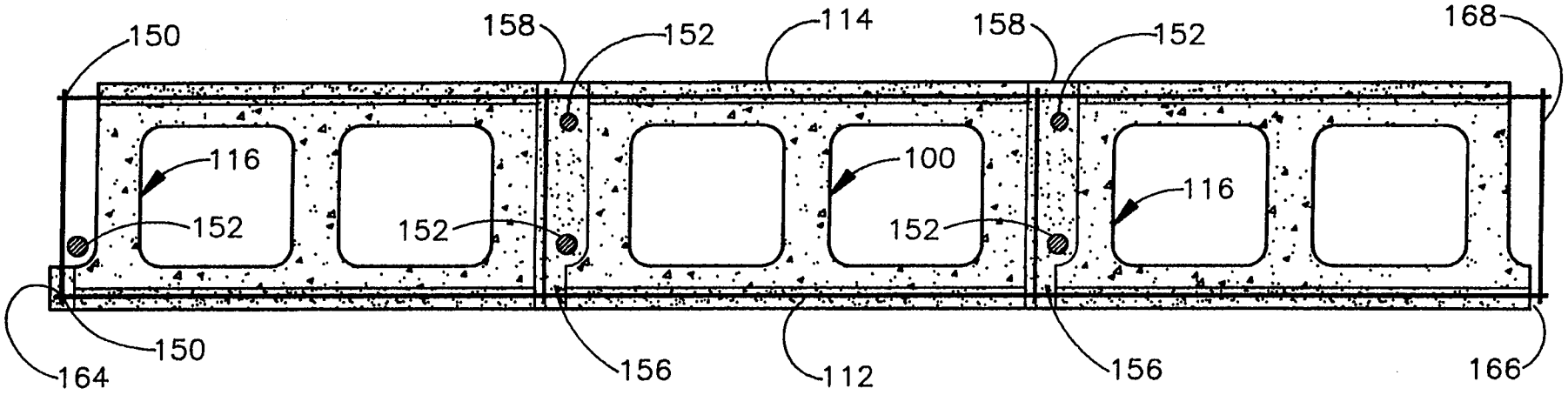
FIG. 16 is a cross-section of a slab of the type used in FIG. 14 showing the ladder reinforcement grout and joint.

With reference to FIG. 16 there is shown a cross section of 3 blocks exemplifying a slab that may be used as a wall but also a roof or floor or deck. Normally a wall would have a course of greater than 3 blocks but only 3 are shown for illustrative purposes. With the blocks in horizontal position on the cushion-faced pallet 132 such as in FIG. 25 and with the ends dammed in any suitable manner and the reinforcement as shown with the ladder reinforcement between each course of blocks, a fluid grout is poured into each grout pour opening 158. The grout used is a fluid grout and for purposes of this invention it is a grout that has an efflux time when a flow cone is used in accordance with ASTM C939 of between 9 and 11 seconds and preferably 10 seconds. To give an idea of how liquid this grout is, water has an efflux time using a flow cone of 8 seconds. An efflux time of 12 seconds will not work as the grout will be too thick.

The grout is preferably prepared using standard masonry sand with a ratio of 2.5 of sand to 1 part of cement. Excess water is added to increase the liquidity using a total of preferably 12 gallons of water per sack of cement. A sack of cement is 94 lbs. or 1 cubic foot. Normally when this amount of water is used substantial shrinkage problems in the grout are created as the grout cures and the grout is a weak material after curing. However, an important aspect of this invention is that the spaces for receiving the reinforcing steel, both the special ladder type 144 and regular reinforcing bars 152 located between the blocks in the trough 157 and along especially the long ledges 112 and 122 of the blocks are surrounded by a dry and absorbent block. The excess water is immediately absorbed by the block from the fluid grout so that there are no shrinkage or strength problems in the cured grout. This absorption occurs within just a few minutes and as fast as the fluid grout is normally poured.

The fluid grout is usually poured through a spout into the pour opening 158 and immediately goes into the trough 157 and to the bottom where it spreads transversely down the length of the adjoining long ledges 112 and 122 to surround all of the reinforcing steel which is present. The fluid grout is poured into the trough 157 until it flows all the way to the end and it is usually poured until the trough is approximately one-half full or about 4 inches in depth. Since there is only a 4 inch head on the grout the blocking or damming of the ends of the slab to prevent the grout from running out is easily carried out as the dam has to resist only minimum pressure.

A major key to the success of the invention is that the fluid grout has flowed the entire distance of the long ledges 112 and 122 between the blocks even though the pour was made from the opposite side of the block and this is done without having a pressure grout fill or a post pour vibration and the grout when cured does not have shrinkage or strength problems. The absorption of the water from the fluid grout immediately stiffens it and helps to dam the openings.

The remainder of the trough 157 and the short ledges 114 and 124 are filled preferably by first moisturing the top surface of the slab, dumping grout on the surface and spreading the grout with a squeegee which would fill the remainder of the trough and the short ledges. The grout used on the surface is preferably a flowable grout rather than a fluid grout. The flowable grout is measured on a flow table and is less flowable than the fluid grout used in the first pour. After squeegeeing the flowable grout into the upper part of the trough 157 and short ledges 114 and 124, a moisture impervious cover is placed over the slab and the grout is permitted to cure.

One of the advantages of the invention is that it uses very little grout and permits the utilization of a fast curing grout that cures in less than 1 hour if such is desired. Normally a fast curing grout, which may be three times as expensive as regular grout, would not be used, but, if it is used, the need for only a small amount permits its use to be more readily afforded. With further reference to FIG. 16 it is to be noted that the fluid grout is permitted to flow upward at the left end of the slab at 164 to cover the joint 150. This amount that the fluid grout is permitted to flow upward at the end block should not normally be higher than that shown at 164.

Figure 22:
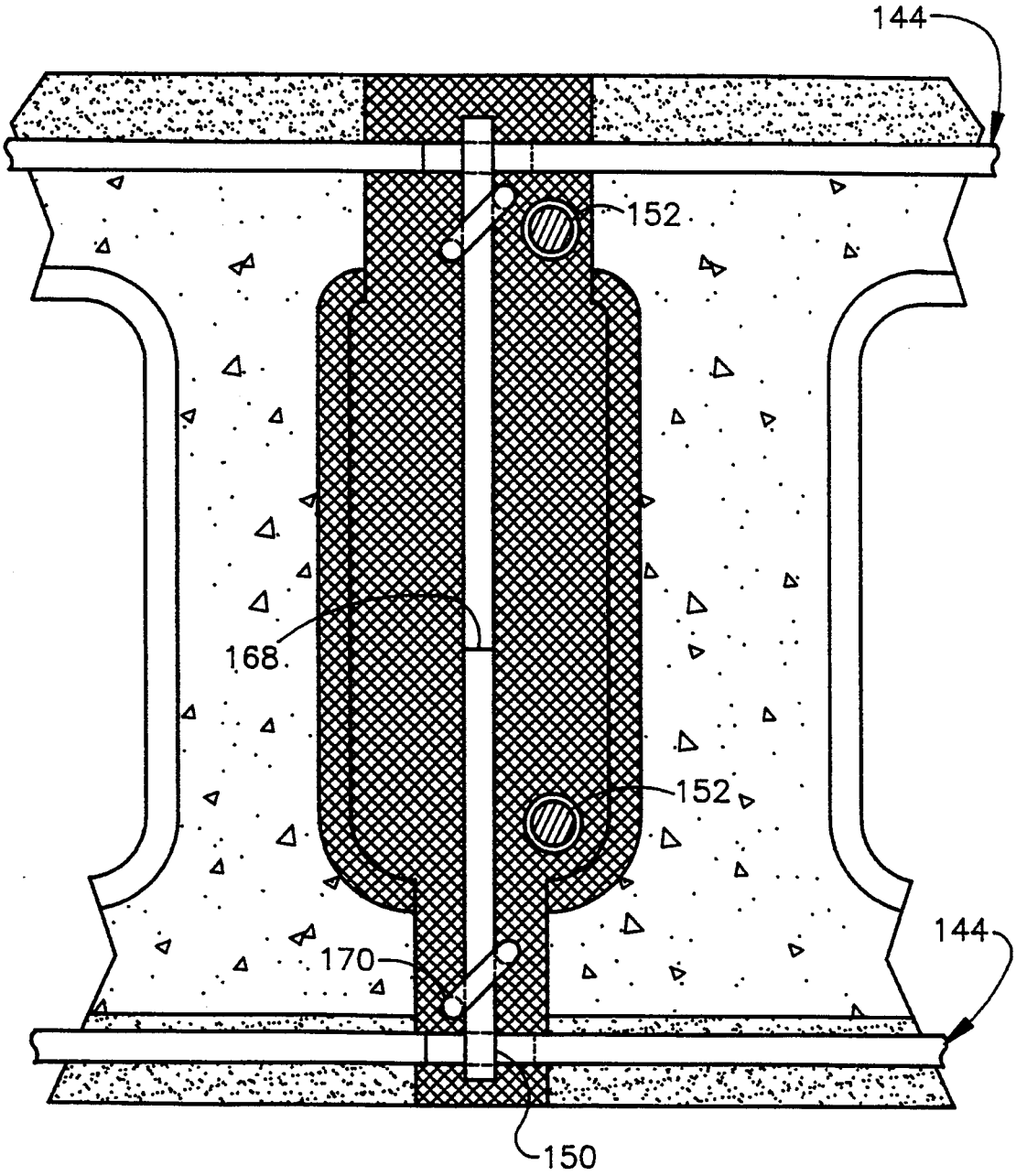
FIG. 22 shows a breakaway cross-section of the field joint of figure FIG. 21.
Figure 23:
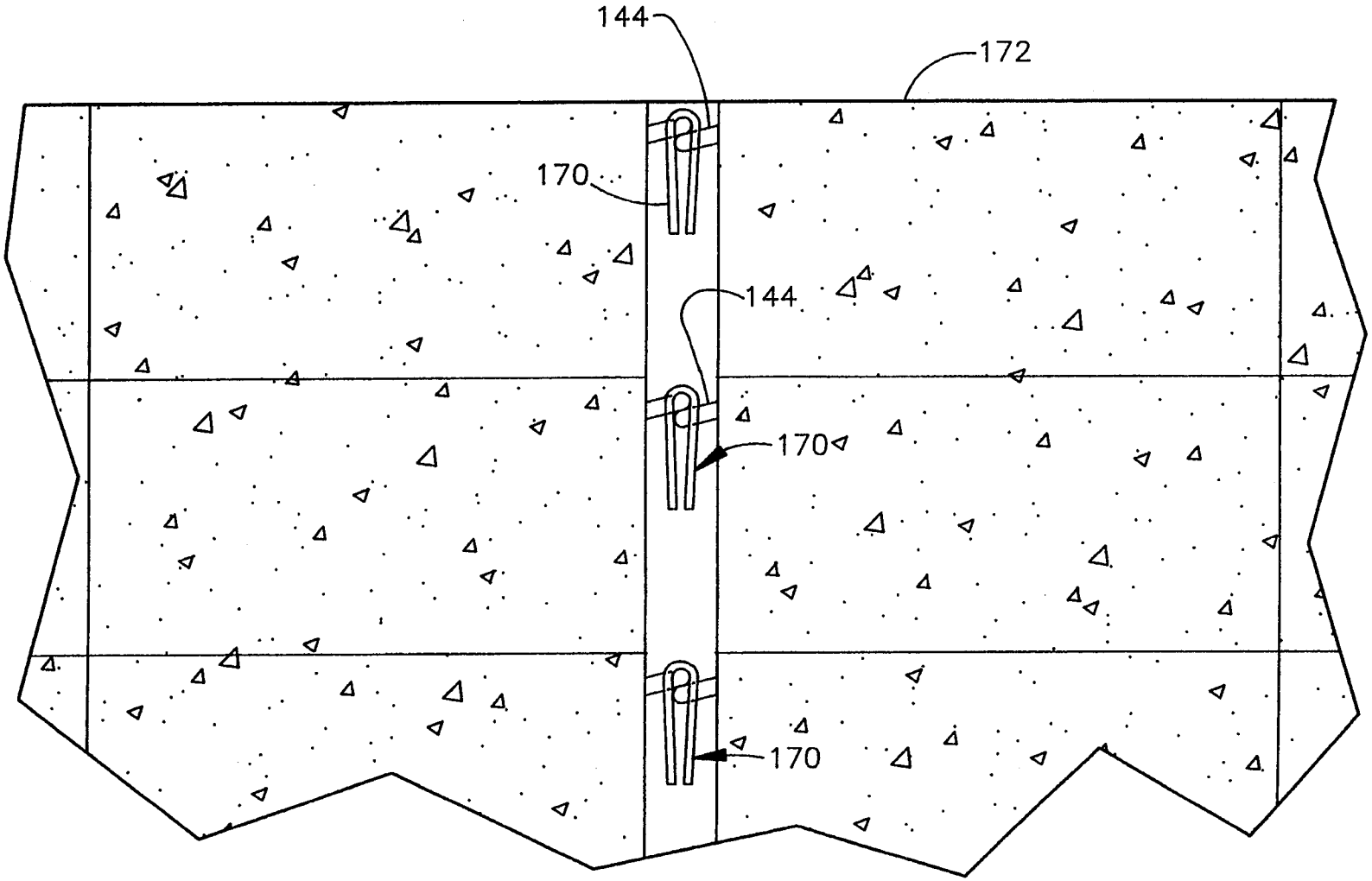
FIG. 23 is a schematic broken away elevation of a field joint of FIG. 21.

The ladder reinforcement steel 144 is cut approximately flush at 166 and part way up the transverse wire 148 at cut 168. This cut 168 is on the right end of the slab and helps provide a lapping tie connection in the keyway joint as seen in FIG. 22. The keyway joint is prepared in the field after the slab has been erected and the reinforcing bars 152 may be tied to the slab before the erection or added later. It is noted that at the top of the joint the ladder reinforcement as earlier described in connection with FIG. 16 of the left slab over laps with the cut reinforcement from the right side of FIG. 16. If necessary the ladder reinforcement may be slightly bent to permit them to slide past one another. FIG. 22 also shows in cross section plan view hairpin reinforcements 170 which are preferably made from 9 gauge reinforcing steel wire. The hairpins 170 are used to help tie the ladder type special reinforcing steel 144 together at the field joints. This is better seen with reference to FIG. 23 where there is a highly schematic elevation view of the wall showing the hairpin reinforcements 170 placed in the field in the keyway joint. The top of the wall is 172. The grout applied to the field joint is formed and poured in the same manner that it is normally applied to other types of field erected wall slabs as is well known in the trade.

Figure 20:
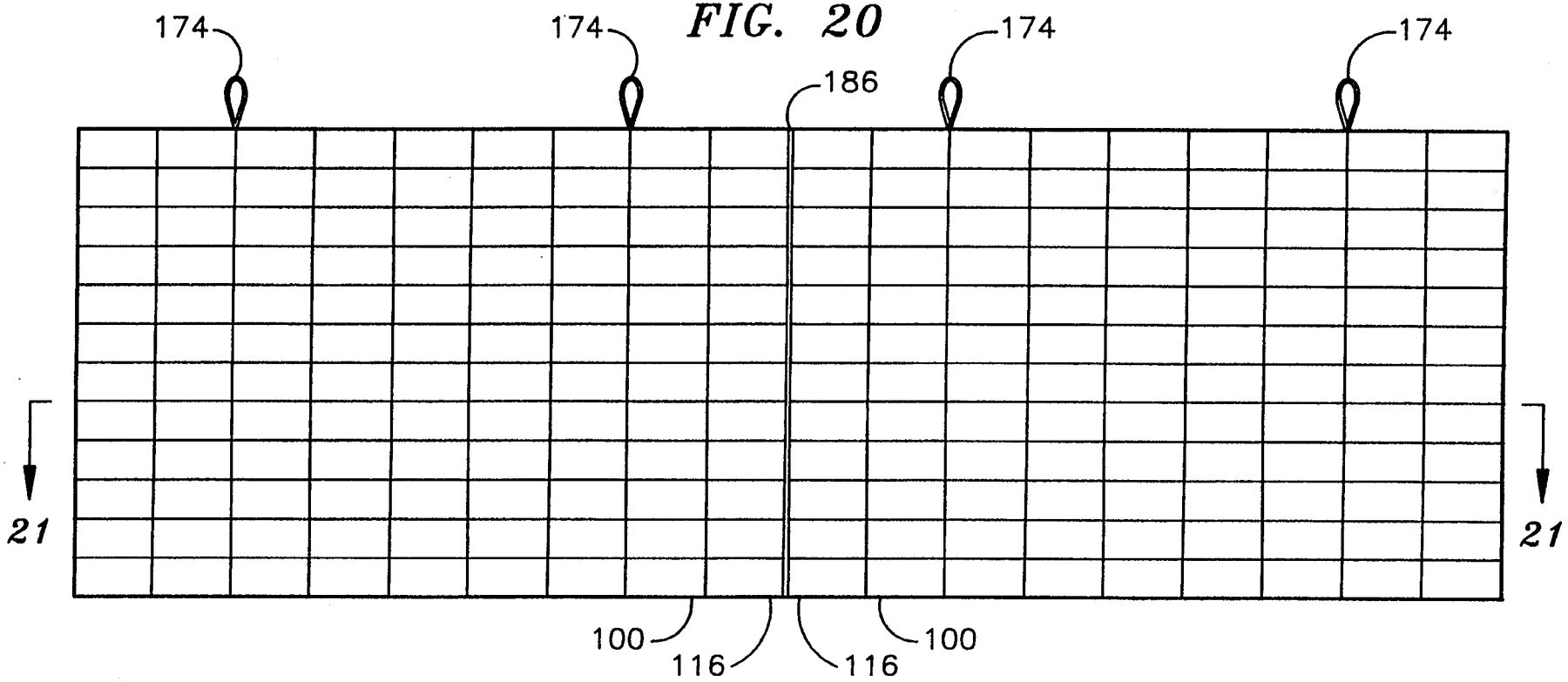
FIG. 20 shows a side view of a typical masonry wall made in accordance with an embodiment of this invention.
Figure 21:
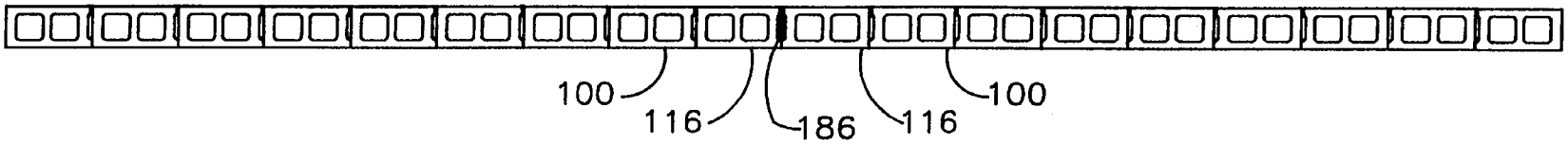
FIG. 21 is a section taken along the wall of FIG. 20.

With reference to FIGS. 20 and 21 there is shown in highly schematic form an elevation view of a wall made in accordance with this invention and a plan view of the same wall. The wall represents one that is typically 8' in height and 24' long made from two slabs of 12' widths. Handling loops 174 have been provided in the premanufactured slabs to permit their handling and erection on the job site. The cross section taken along lines 21—21 of FIG. 20 as shown in FIG. 21 indicates that each 12' wide slab is made up of 8 of the special blocks having only one open end plus a ninth keyway special block to form the field joint.

Figure 15:
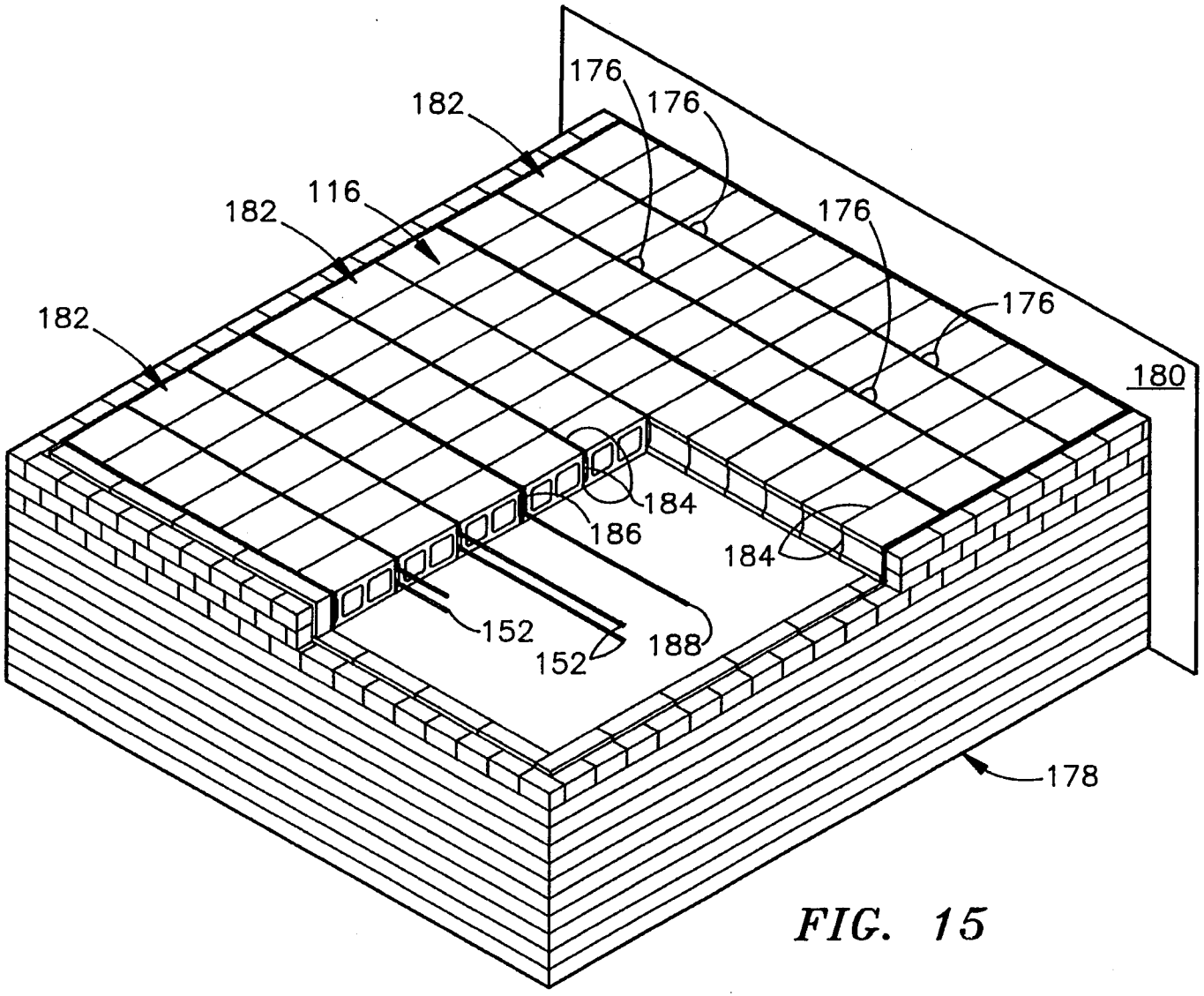
FIG. 15 is a perspective view, partially cut away, showing a composite building system made from premanufactured slabs using a combination of fluid and flowable grout.

Up to now the invention has been described primarily with reference to the use of the special block and method in making walls. However, it is equally utilizable for decks, floors and roofs and similar construction. The primary difference being that the reinforcing bars may be chosen of different strengths. For example, in floors and roofs the bottom bar of FIG. 16 may be a number 5 bar and the top bar a number 3 bar. In the case of walls both may be number 3 bars. Also the handling loops would of course be different when the slabs are being placed in a relatively horizontal position as opposed to a vertical position. This is illustrated in FIG. 15 which shows the use of the invention in a typical application to a floor where the handling loops 176 are positioned for horizontal placement of the slabs. Also the slabs for this application would normally be longer and narrower than a slab used for a wall and would be positioned on the cushioned pallet by laying them on their sides in a horizontal plane.

With further reference to FIG. 15 a standard foundation 178 is provided adjacent an existing wall 180. Placed over the foundation 178 are premanufactured slabs 182. Each slab is manufactured in accordance with this invention and contains reinforcing bars 152 and joints made with grout in accordance with this invention. The field joint 186 is made using flowable grout and suitable standard reinforcing bars 188. The lifting hooks 176 are simply made from 9 gauge reinforcing wire and are sometimes referred to as croquet wickets. One, two or three may be utilized together. In one test slab the weight dictated that 2 croquet wickets be used at each of four lifting points. The lifting hooks are embedded in the joints 6 inches prior to the grout curing. Once the grout is cured the 6 inch embedment is sufficient to provide a pull out strength that permits the lifting hooks to be satisfactorily utilized. After erection they are cut off.

Numerous modifications and adaptations of the present invention will be apparent to those so skilled in the art. For example, the invention can be used to make a wall by first making a composite structure in the horizontal position, and after curing, tilting it upward for the wall. Thus, it is intended by the following claims to cover all such modifications and adaptations which fall within the true spirit and scope of the invention.

What is claimed is:

1. A method for reinforcing a masonary structure by reinforcing members including the steps of:

providing a masonary structure that is sufficiently dry and absorbent to absorb water and having an opening for receiving a reinforcing member;

placing a reinforcing member in said opening;

filling at least part of said opening with a fluid grout containing water with a part of said water in said grout being absorbed by said masonary structure; and permitting said grout to cure and bind said reinforcing member to said masonary structure.

2. The method of claim 1 wherein said masonry structure is made into a slab by positioning a number of masonry blocks laid on their side in rows and columns in a generally horizontal plane with said blocks in the same column being in contact with one other and said blocks in the same row having sufficient space between each other to permit said fluid grout to be poured therebetween.

3. The method of claim 2 wherein said masonry blocks rest on a resilient pad which acts as a gasket at the time said fluid grout is poured into said space between said blocks.

4. The method of claim 3 wherein said reinforcement member is steel in the form of a ladder having two parallel spaced apart longitudinal wires and evenly spaced transverse wires affixed to said longitudinal wires with said longitudinal wires being received in said opening in the form of steps running along the edges of both long sides of the blocks and the transverse wires located in said openings provided between blocks.

5. A method for reinforcing a masonry structure by reinforcing members including the steps of:

providing a masonry structure that is sufficiently dry and absorbent to absorb water and having an opening; placing a reinforcing member in said opening filling at least part of said opening with a fluid grout containing water which has an efflux time of about 9 to 11 seconds when using a flow cone in accordance with ASTM C 939 with a part of said water in grout being absorbed by said masonry structure; and permitting said grout to cure and bind said reinforcing member to said masonry structure.

6. The method of claim 5 wherein said fluids grout has an efflux time of about 10 seconds when using a flow cone in accordance with ASTM C939.

7. The method of claim 5 wherein said fluid grout is poured to only partially fill said space between said column of blocks which includes the additional steps of:

sprinkling said slab with water;

placing grout on said slab to fill the remainder of said space between said columns of blocks; and covering said slab with a moisture impervious barrier during curing of the grout.

8. The method of claim 5 which include the following steps:

stacking said masonary blocks into a vertical wall with said ladder reinforcement place on top of each row, and tilting said stack of masonary blocks to a horizontal position.

* * * * *